US009234706B2

(12) United States Patent
Hamada et al.

(10) Patent No.: US 9,234,706 B2
(45) Date of Patent: Jan. 12, 2016

(54) CROSS-FIN TYPE HEAT EXCHANGER AND REFRIGERATION CYCLE APPARATUS INCLUDING THE SAME

(75) Inventors: Mamoru Hamada, Tokyo (JP); Yusuke Tashiro, Tokyo (JP); Hisatoshi Fukumoto, Tokyo (JP); Koji Yamashita, Tokyo (JP); Hiroyuki Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 394 days.

(21) Appl. No.: 13/640,321

(22) PCT Filed: May 12, 2010

(86) PCT No.: PCT/JP2010/003216

§ 371 (c)(1),
(2), (4) Date: Oct. 10, 2012

(87) PCT Pub. No.: WO2011/141962

PCT Pub. Date: Nov. 17, 2011

(65) Prior Publication Data

US 2013/0031932 A1 Feb. 7, 2013

(51) Int. Cl.

| | |
|---|---|
| ***F28F 1/32*** | (2006.01) |
| ***F28D 1/047*** | (2006.01) |
| ***F28F 17/00*** | (2006.01) |
| *F25B 39/00* | (2006.01) |
| *F28D 21/00* | (2006.01) |

(52) U.S. Cl.

CPC ..... *F28D 1/0478* (2013.01); *F28F 1/32* (2013.01); *F28F 1/325* (2013.01); *F28F 17/00* (2013.01); *F25B 39/00* (2013.01); *F28D 2021/0071* (2013.01)

(58) Field of Classification Search

CPC ..... F28F 1/32; F28F 13/187; F28F 13/003; F28F 13/185

USPC ..... 165/133, DIG. 514, DIG. 512

See application file for complete search history.

(56) References Cited

U.S. PATENT DOCUMENTS 4,353,224 A * 10/1982 Nonogaki et al. ..... 62/515

FOREIGN PATENT DOCUMENTS

| | | |
|---|---|---|
| EP | 2 172 729 A1 | 4/2010 |
| JP | 62-155493 A | 7/1987 |

(Continued)

OTHER PUBLICATIONS

Extended European Search Report dated Sep. 1, 2014 issued in the corresponding EP patent application No. 10851349.0 (and English translation).

International Search Report mailed on Jul. 6, 2010 for the corresponding International patent application No. PCT/JP2010/003216 (and English translation).

Office Action dated Sep. 30, 2014 issued in corresponding CN patent application No. 201080066718.0 (and English translation).

Office Action mailed Sep. 17, 2013 in the corresponding JP application No. 2012-514607 (English translation).

(Continued)

*Primary Examiner* — Cassey D Bauer

(74) *Attorney, Agent, or Firm* — Posz Law Group, PLC

(57) ABSTRACT

A plurality of heat transfer fins are arranged so as to surround straight pipe portions of heat transfer tubes connected through bends in a serpentine arrangement. Heat transfer surfaces for transferring heat between air of the heat transfer tubes and the heat transfer fins have holes each having a radius smaller than the critical radius of a nucleus that occurs upon phase change from water vapor to condensed water droplets such that the holes are filled with the air at all times. Water is allowed to move from the holes filled with the air having low surface energy to metal part having high surface energy, thus improving drainage.

8 Claims, 12 Drawing Sheets

(56) References Cited

FOREIGN PATENT DOCUMENTS

| | | | | | |
|---|---|---|---|---|---|
| JP | 06-331290 | A | | 11/1994 | |
| JP | 2002-90084 | A | | 3/2002 | |
| JP | 2006-046695 | A | | 2/2006 | |
| WO | WO2009/017039 | | * | 5/2009 | ..... F25B 17/08 |
| WO | WO 2009/119474 | A1 | | 10/2009 | |

OTHER PUBLICATIONS

Office Action dated Feb. 21, 2014 issued in the corresponding CN patent application No. 201080066718.0 (and English translation).
Office Action mailed Apr. 9, 2015 in the corresponding CN application No. 201080066718.0 (English translation attached).
Office Action issued Oct. 14, 2015 in the corresponding EP application No. 10851349.0.

* cited by examiner (a)

(b)

CROSS-FIN TYPE HEAT EXCHANGER AND REFRIGERATION CYCLE APPARATUS INCLUDING THE SAME

CROSS REFERENCE TO RELATED APPLICATION

This application is a U.S. national stage application of PCT/JP2010/003216 filed on May 12, 2010.

TECHNICAL FIELD

The present invention relates to a cross-fin type heat exchanger in which a plurality of heat transfer fins are arranged in an array around straight pipe portions of a serpentine heat transfer tube with a plurality of bends, and a refrigeration cycle apparatus including the cross-fin type heat exchanger.

BACKGROUND ART

In a typical cross-fin type heat exchanger in which a plurality of heat transfer fins are arranged in an array around straight pipe portions of a serpentine heat transfer tube with a plurality of bends, when heat transfer surfaces are cooled so that the surface temperature is at or below the air dew point temperature, condensation of water vapor in the air occurs on the heat transfer surfaces and water droplets are generated on the surfaces. In particular, when the temperature of the fins is at or below 0° C., a frosting phenomenon occurs such that water vapor in the air forms frost on the heat transfer surfaces. As the frost on the heat transfer surfaces grows, air paths through which the air passes are clogged. Disadvantageously, airflow resistance increases, so that the performance of an apparatus markedly decreases.

To avoid the performance decrease due to frost, a defrosting operation for removing frost formed on the surfaces of the heat exchanger has to be periodically performed. For the defrosting operation, for example, a hot gas system in which the heat exchanger, serving as a target, is heated from the inside by switching of flow directions of a refrigerant in a refrigeration cycle or a heater system in which the heat exchanger is heated from the outside by a heater disposed near the heat exchanger is used. During the defrosting operation, a role of the apparatus, for example, comfort of air conditioning, is reduced. Furthermore, the efficiency of such a device is also reduced. It is therefore necessary to shorten the time of the defrosting operation as much as possible.

As regards the frost problem, according to a related-art, the surface of each fin is coated with a hydrophilic coating layer, the hydrophilic coating layer is exposed to plasma to form fine asperities thereon so that the area of the hydrophilic coating layer on the surface of the fin is increased, thus enhancing the effect of the coating layer, namely, providing superhydrophilicity. Accordingly, adhesion water, which will cause frost, becomes to have affinity with the surface of the fin, thus facilitating gravitational flow discharge. Alternatively, the surface of each fin is coated with a water-repellent or hydrophobic coating layer, the hydrophobic coating layer is exposed to plasma to form fine asperities so that the area of the hydrophobic coating layer on the surface of the fin is increased, thus enhancing the effect of the coating layer, namely, providing superhydrophilicity. Accordingly, adhesion water, which will cause frost, tends to be shaped into a sphere, thus facilitating gravitational flow discharge from the surface of the fin. Consequently, forming of frost is delayed (refer to Patent Literature 1, for example).

CITATION LIST

Patent Literature

Patent Literature 1: Japanese Unexamined Patent Application Publication No. 2002-90084 (FIG. 2)

SUMMARY OF INVENTION

Technical Problem

As described above, in the cross-fin type heat exchanger of the related art, gravitational drainage is enhanced using the effect of the hydrophilic or hydrophobic coating layer on the surface of each fin, thus achieving the effect of delaying frost formation.

In a cross-fin type heat exchanger including, for example, flat heat transfer tubes through which a refrigerant flows, however, the flat heat transfer tubes are often arranged such that the longitudinal direction of each tube is horizontal. It is difficult to expect the effect of gravitational drainage in the horizontally arranged portions. For the same reason, it is also difficult to expect the effect of shortening defrosting time.

A technical challenge that the present invention addresses is to obtain a draining effect without relying on gravity in order to enable improvement of the drainage, extension of time until the spaces (air paths) between fins becomes clogged, and shortening of defrosting time.

Solution to Problem

A retainer for a cross-fin type heat exchanger according to the present invention has the following structure. That is, the cross-fin type heat exchanger in which a plurality of heat transfer fins are arranged in an array around straight pipe portions of a serpentine heat transfer tube with a plurality of bends includes holes being provided on heat transfer surfaces of the heat transfer tubes and the heat transfer fins for transferring heat between air, in which the holes each having a radius smaller than a critical radius of a nucleus that is generated upon phase change from water vapor to condensed water droplets.

Advantageous Effects of Invention

In the cross-fin type heat exchanger according to the invention, since the holes arranged on the heat transfer surfaces, used for transferring heat between air, of the heat transfer tubes and the heat transfer fins each have a radius smaller than the critical radius of each nucleus that occurs upon phase change from water vapor to condensed water droplets, condensed water droplets are not formed in the holes. The holes are filled with air at all times. Furthermore, each heat transfer surface includes air parts and metal part at all times. As the surface energy of an object is higher, the object is more likely to be wet with water. Accordingly, water moves to the metal part having high surface energy rather than to the air having low surface energy. The movement of water from the holes filled with the air to the metal part causes driving force that facilitates drainage, thus improving drainage. Advantageously, frost formation can be delayed due to removal of condensed water droplets, serving as nuclei for frost growth, and the defrosting time can be shortened by improvement of the drainage during defrosting. Furthermore, a highly efficient operation of a refrigeration cycle apparatus including the cross-fin type heat exchanger can be achieved.

DESCRIPTION OF EMBODIMENTS

Embodiment 1

Figure 1:
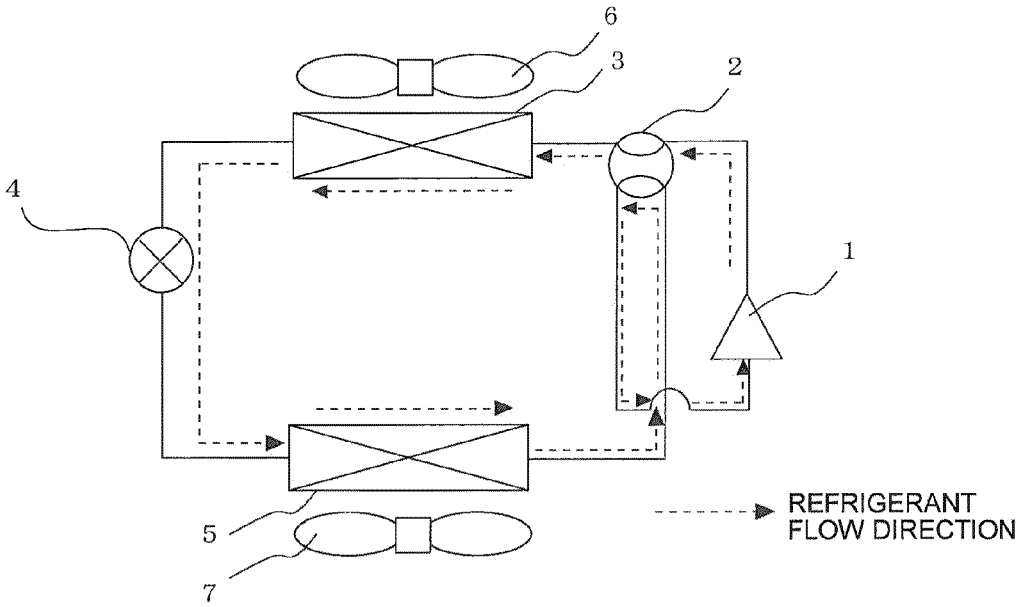
FIG. 1 is a diagram illustrating a refrigerant circuit of a refrigeration cycle apparatus when a cross-fin type heat exchanger according to Embodiment 1 of the invention is used as an evaporator.

FIG. 1 is a diagram illustrating a refrigerant circuit of a refrigeration cycle apparatus when a cross-fin type heat exchanger according to Embodiment 1 of the invention is used as an evaporator. As illustrated in FIG. 1, the refrigeration cycle apparatus includes a compressor 1, a four-way valve 2, a condenser 3, expansion means 4, and an evaporator 5 which are connected in a closed loop by refrigerant pipes, and further includes a condenser fan 6 and an evaporator fan 7. The refrigerant circuit is filled with a refrigerant.

In the case where the four-way valve 2 is in a switching position as illustrated in FIG. 1, the refrigerant is compressed in the compressor 1 into a high-temperature high-pressure gas refrigerant, passes through the four-way valve 2, and flows into the condenser 3. The refrigerant transfers heat in the condenser 3 such that it turns into a liquid refrigerant and is then expanded by the expansion means 4 into a low-pressure two-phase gas-liquid refrigerant. After that, the refrigerant removes heat from ambient air in the evaporator 5 such that it turns into a gas and then returns to the compressor 1. In the case where the refrigerant is a chlorofluorocarbon refrigerant or HC refrigerant, since condensation occurs such that a gaseous refrigerant and a liquid refrigerant exist, it has been described as a condenser 3 that condenses a gas into a liquid; however, in the case where a supercritical pressure refrigerant, such as $CO_2$, is used as a refrigerant, this condenser 3 becomes a radiator that transfers heat.

Figure 2:
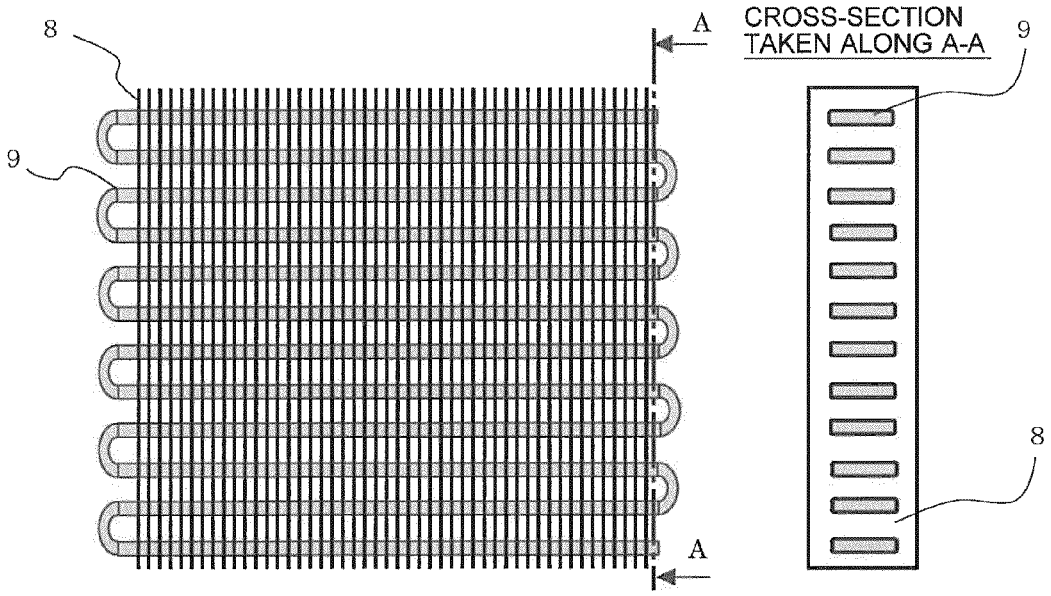
FIG. 2 includes a front view of the evaporator as an application of the cross-fin type heat exchanger according to Embodiment 1 of the invention and a cross-sectional arrow view taken along the line indicated by arrows A-A.

FIG. 2 illustrates the details of the evaporator 5 in FIG. 1. The evaporator 5 includes a plurality of heat transfer fins 8 and a plurality of heat transfer tubes 9. The plurality of heat transfer fins 8 are arranged at regular intervals. The heat transfer tubes 9 are arranged so as to extend through penetrating holes arranged in the fins. The heat transfer tubes 9 are flat and remove heat by vaporization of the refrigerant flowing through the tubes and exchange heat through the outer surfaces of heat transfer tubes and the heat transfer fins 8. As a material for the fins and the heat transfer tubes, an aluminum plate that is easy to work and has high thermal conductivity is often used. To achieve an efficient process of exchanging heat with the air, the evaporator 5 is supplied with the air by the evaporator fan 7 positioned in parallel to the arrangement of the heat transfer fins 8. The fins will be described as flat plate-shaped fins herein. For example, if corrugated heat transfer fins are used, the same operation and advantages can be obtained.

Figure 3:
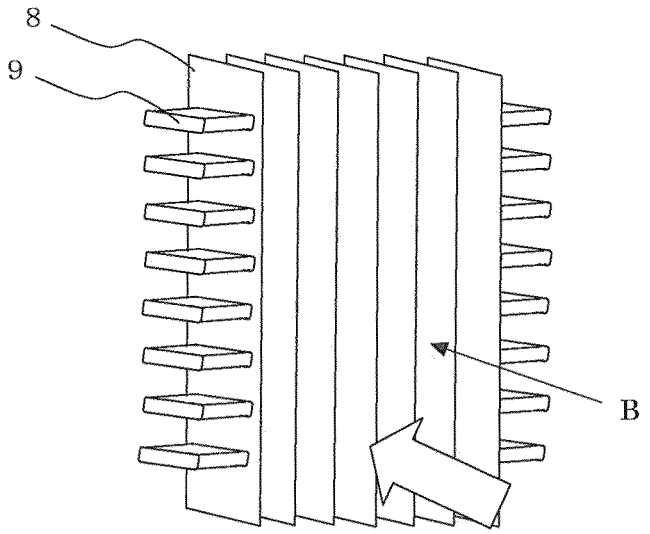
FIG. 3 includes a perspective view illustrating the relationship between the evaporator as the application of the cross-fin type heat exchanger according to Embodiment 1 of the invention and a frost layer and a B arrow view thereof.
Figure 3:
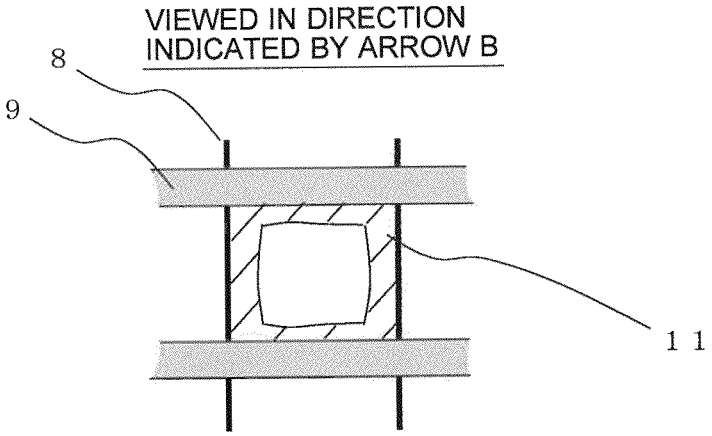

For example, in an air-conditioning apparatus, in the case where an outdoor heat exchanger functions as the evaporator 5 in a heating operation and the temperature of air flowing into the evaporator 5 is 2° C., an evaporating temperature of the refrigerant in the evaporator 5 is approximately −5° C. The temperature of the heat transfer surfaces is at or below 0° C. and frost occurs on the heat transfer surfaces by water vapor in the flowing air. Due to frost formation, each space (air path) between the heat transfer fins 8 is clogged with a frost layer 11 as illustrated in FIG. 3 and air volume is reduced, such that the amount of heat exchanged with the air is reduced. Disadvantageously, the efficiency of the apparatus is degraded. FIG. 3(*a*) is a perspective view of essential parts of the heat exchanger and (b) is a B arrow view thereof.

When there is frosting on the heat exchanger, it is important to delay clogging of the spaces (air paths) between the heat transfer fins 8 by reducing the amount of frost generated on the heat transfer surfaces or even with the same amount of frost, generating frost with higher density.

Figure 4:
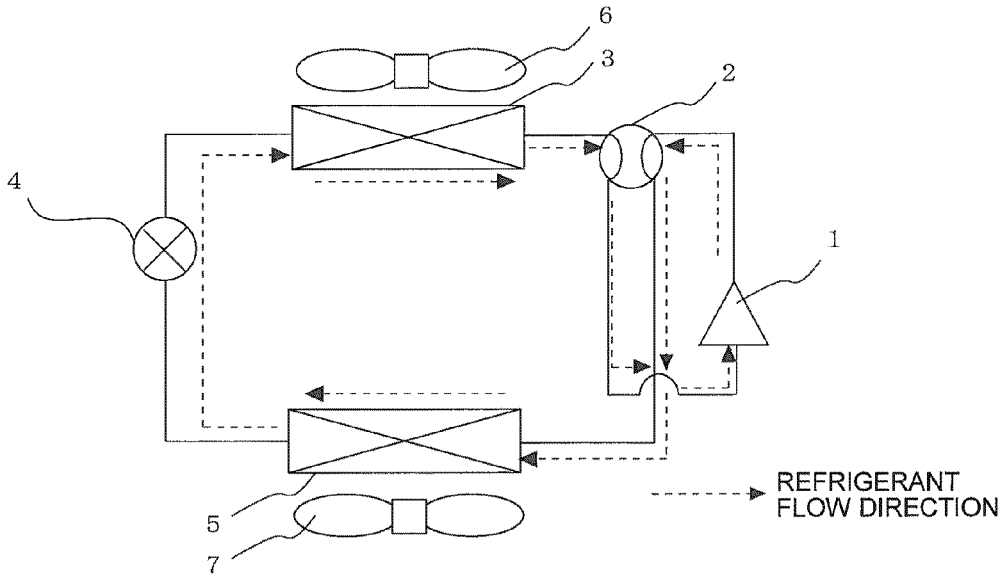
FIG. 4 is a diagram illustrating the flow of a refrigerant during defrosting in the refrigerant circuit of the refrigeration cycle apparatus when the cross-fin type heat exchanger according to Embodiment 1 of the invention is used as an evaporator.

To remove the frost layer 11 generated on the heat transfer surfaces, the apparatus performs a defrosting operation. In the air-conditioning apparatus, for example, the four-way valve 2 performs switching as illustrated in FIG. 4 such that the high-temperature high-pressure gas refrigerant flows into the evaporator 5, thus melting the frost layer 11. The melted frost, as melt water 12 produced by defrosting, moves on the heat transfer fins 8, drops in the direction of gravity, and then flows to the outside.

During a defrosting operation, since the heating operation is stopped, room temperature decreases. The decrease of the room temperature impairs comfort. In addition, heating load increases in accordance with the decreased room temperature when the operation is returned to the heating operation, thus degrading efficiency. As defrosting time becomes longer, a reduction in room temperature becomes larger. Accordingly, the shorter the defrosting time, both comfort and energy saving are improved. However, if the heating operation is resumed while the melt water 12 still remains on the heat transfer surfaces, frost occurs such that the remaining melt water 12 on the heat transfer surfaces serves as the starting points of frost. It is therefore important to surely remove the melt water 12 from the heat transfer surface.

Figure 5:
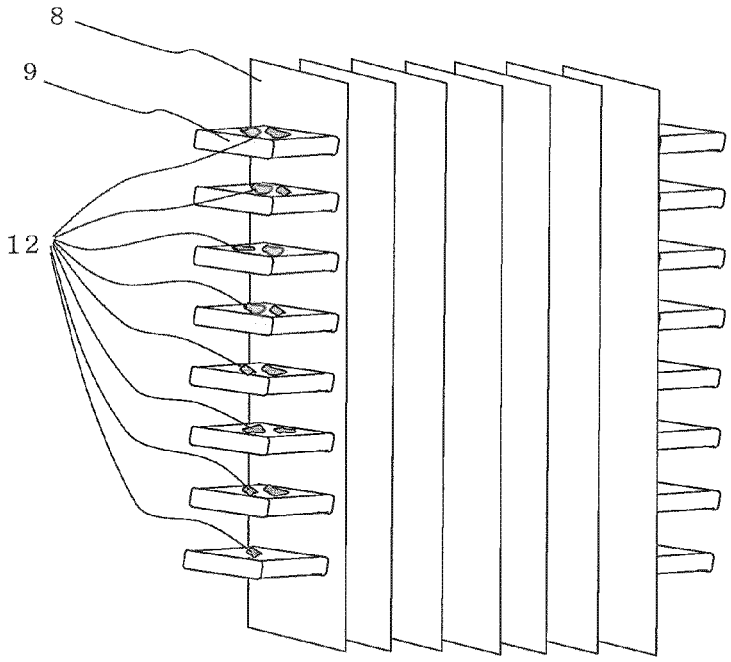
FIG. 5 is a perspective view illustrating the relationship between the evaporator as the application of the cross-fin type heat exchanger according to Embodiment 1 of the invention and melt water produced by defrosting.

In particular, in the cross-fin heat exchanger, illustrated in FIG. 2, employing the flat tubes as the heat transfer tubes 9, the melt water 12 is accumulated on the upper surface of each heat transfer tube 9 as illustrated in FIG. 5, such that the water is not easily drained. Accordingly, improvement of drainage becomes more important.

A method of improving the drainage to delay clogging of the spaces (air paths) between the heat transfer fins will be described in detail below. First, the critical radius of a nucleus that occurs upon phase change from water vapor to condensed water droplets will be described. Phase change is a phenomenon in which nuclei occur in a stable environmental phase and the growth of the nuclei causes a different phase. For the growth of the nuclei, the free energy, dG, of the entire phase has to be reduced thermodynamically. The free energy upon the occurrence of a nucleus having a radius r is given by the following Equation (1).

[Math. 1]

$$dG = \frac{4\pi r^3}{3v} d\mu + 4\pi r^2 \gamma \tag{1}$$

Figure 6:
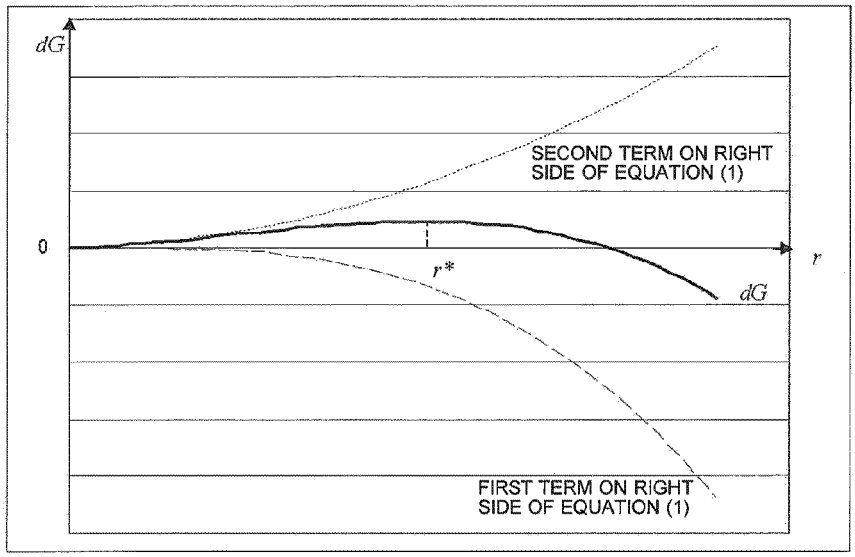
FIG. 6 is a graph illustrating the r dependence of Equation (1).

In this equation, v denotes the volume of a single molecule, dμ denotes a variation in chemical potential per molecule, and γ denotes the surface energy density. A reduction in dG by the growth of the nuclei means that an increase in γ may lead to reduced dG. The r dependence of Equation (1) is illustrated as a graph in FIG. 6. In FIG. 6, the axis of ordinates indicates a value of Equation (1) and the axis of abscissas denotes the radius r of the nucleus. The first term on the right side of Equation (1) decreases negatively with increase in r. The second term on the right side of Equation (1) increases positively with increase in r. Referring to FIG. 6, when r=r*, Equation (1) has a maximum value. When 0<r<r*, dG increases with increasing r. When r>r*, dG decreases with increasing r. In other words, only the nucleus with the radius r greater than or equal to r* can continue to grow. Such r is called a "critical radius r*". The value r* is obtained by differentiating Equation (1) with respect to r and is given by the following Equation (2).

[Math. 2]

$$r^* = \frac{2\gamma v}{d\mu} \tag{2}$$

Next, control of phase change from water vapor to condensed water droplets will be described. It is assumed that the above-described generation process corresponds to phase change from water vapor to condensed water droplets. In considering the change of vapor, dμ in Equation (2), namely, a variation in chemical potential per molecule is given using a pressure in each phase by the following Equation (3).

[Math. 3]

$$d\mu = kT\log\left(\frac{p}{p_e}\right) \tag{3}$$

In this equation, k denotes the Boltzmann constant, T denotes the temperature, p denotes the vapor pressure, and $p_e$ denotes the equilibrium vapor pressure of condensed water droplets.

Substitution of Equation (3) into Equation (2) yields the following Equation (4).

[Math. 4]

$$\frac{p}{p_e} = \exp\left(\frac{2\gamma v}{kTr^*}\right) \tag{4}$$

Figure 7:
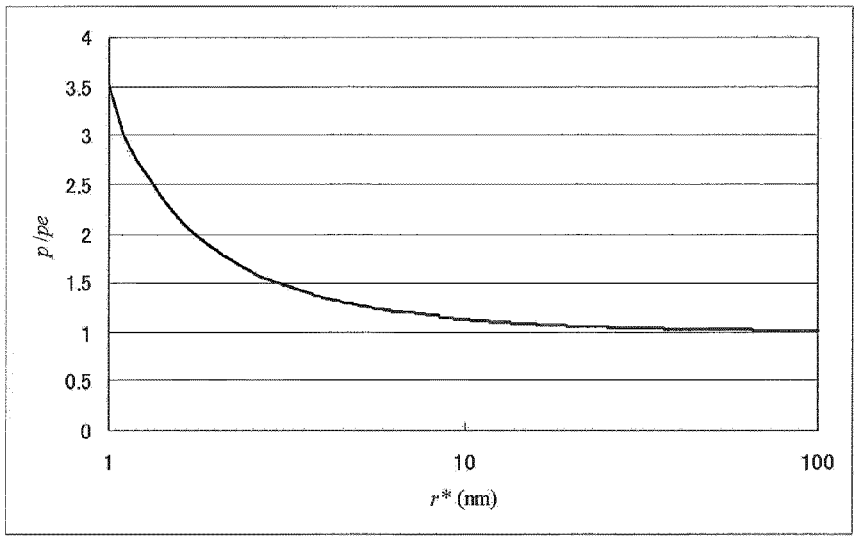
FIG. 7 is a graph illustrating the critical radius dependence of the pressure ratio of vapor pressure to the equilibrium vapor pressure of condensed water droplets.

FIG. 7 is a graph illustrating $p/p_e$ as the function of r* when condensed water droplets are at 0° C. Note that γ=76 [erg/cm$^2$] and v=3*10$^{-23}$ [cm$^3$] (physical properties of water at 0° C.) are used. Note that even if T is varied (for example, T=263 changes to 283 [K]), the value of the r* dependence of p/pe illustrated in FIG. 7 does not markedly change. In other words, the phase change from water vapor to condensed water droplets can be considered using FIG. 7.

For example, when the air condition is 7° C. and the relative humidity is 85%, the vapor pressure in the air is 854 [Pa]. Furthermore, when the temperature of the heat transfer surfaces is −10° C., the temperature of condensed water droplets may be equal to the surface temperature, −10° C. Accordingly, the equilibrium vapor pressure in the condensed water droplets at −10° C. is $p_e$=286 Pa. In other words, p is three times higher than $p_e$. As regards the critical radius r* under such conditions, r*=1 nm as illustrated in FIG. 7. In other words, a nucleus having a radius r>1 nm can grow. Furthermore, a condensed water droplet having a radius at or above 1 nm cannot grow in a hole having a radius of 1 nm. Accordingly, no condensed water droplet is generated in such a hole and the hole is filled with air at all times.

Figure 8:
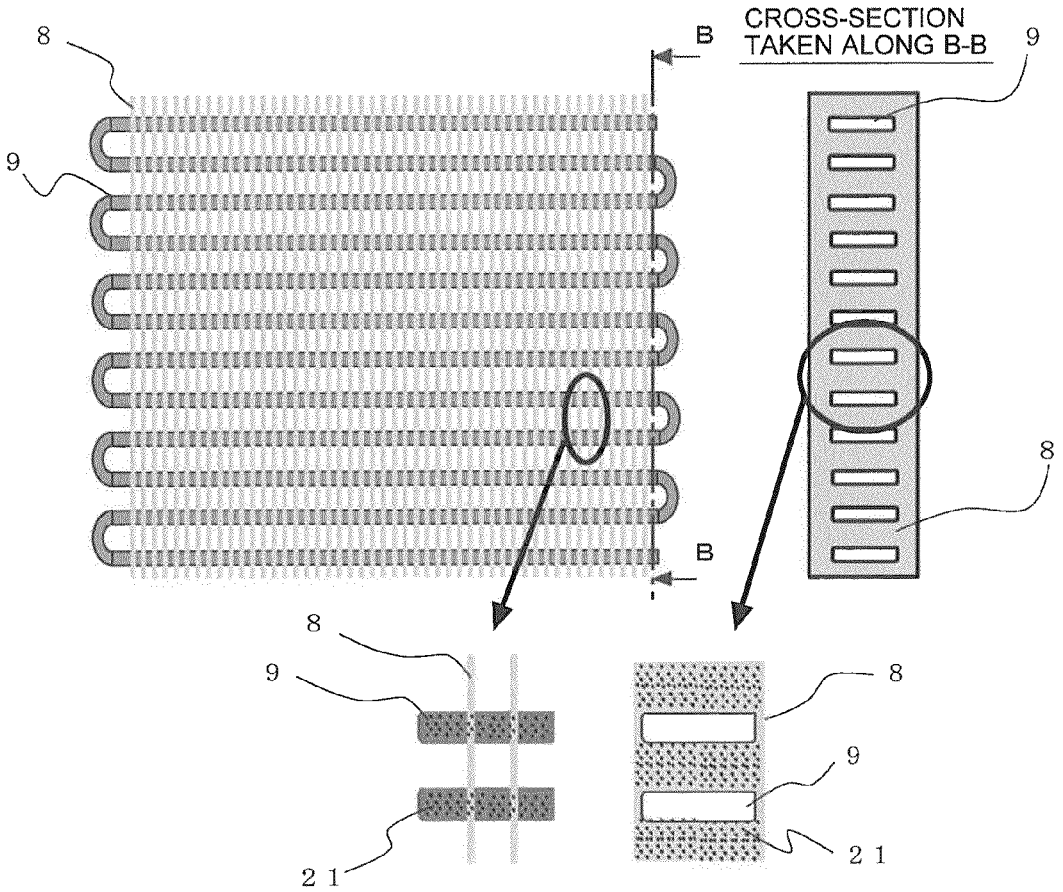
FIG. 8 includes a front view of the evaporator applying the cross-fin type heat exchanger according to Embodiment 1 of the invention, a cross-sectional arrow view thereof taken along the line indicated by arrows B-B, and enlarged views of essential parts thereof.
Figure 9:
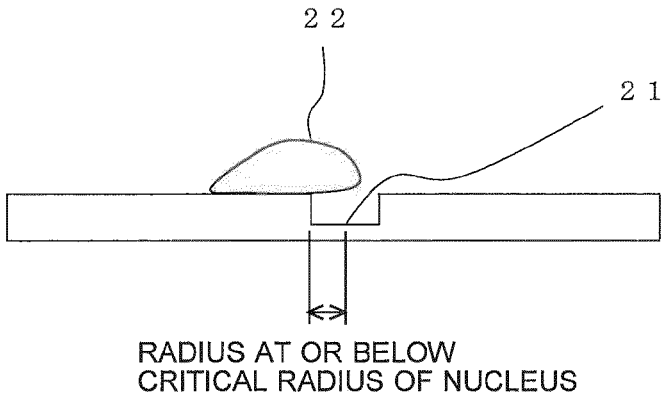
FIG. 9 includes schematic diagrams illustrating the drainage of a surface of the evaporator applying the cross-fin type heat exchanger according to Embodiment 1 of the invention.
Figure 9:
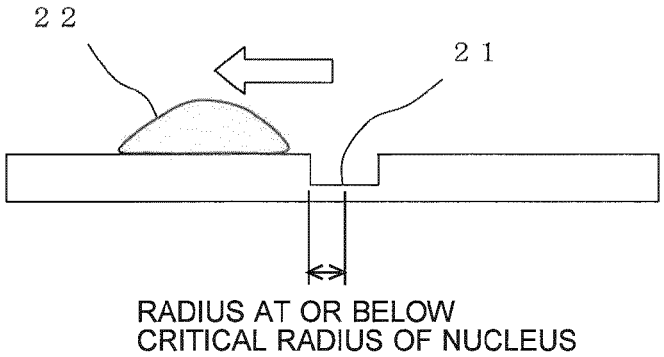

As regards a heat exchanger, if holes 21 each having a radius smaller than the critical radius determined by air conditions and cooled surface conditions are arranged on each heat transfer surface of the evaporator 5 as illustrated in FIG. 8, the heat transfer surface includes parts filled with the air and metal part at all times as illustrated in FIG. 9. The higher the surface energy of an object, the more likely the object is to be wet with water. Accordingly, water moves toward the metal part having high surface energy rather than the air having low surface energy.

In the defrosting operation, the movement of water from each hole 21 filled with air to the metal part causes driving force which facilitates the drainage. Such an effect achieves smooth drainage of water from the heat transfer tubes 9 in the cross-fin type heat exchanger employing the flat tubes functioning as the heat transfer tubes 9. Upon frost formation, subcooled water droplets are removed before freezing, thus reducing the amount of frost. Advantageously, clogging of the spaces (air paths) between the heat transfer fins 8 is delayed.

Figure 10:
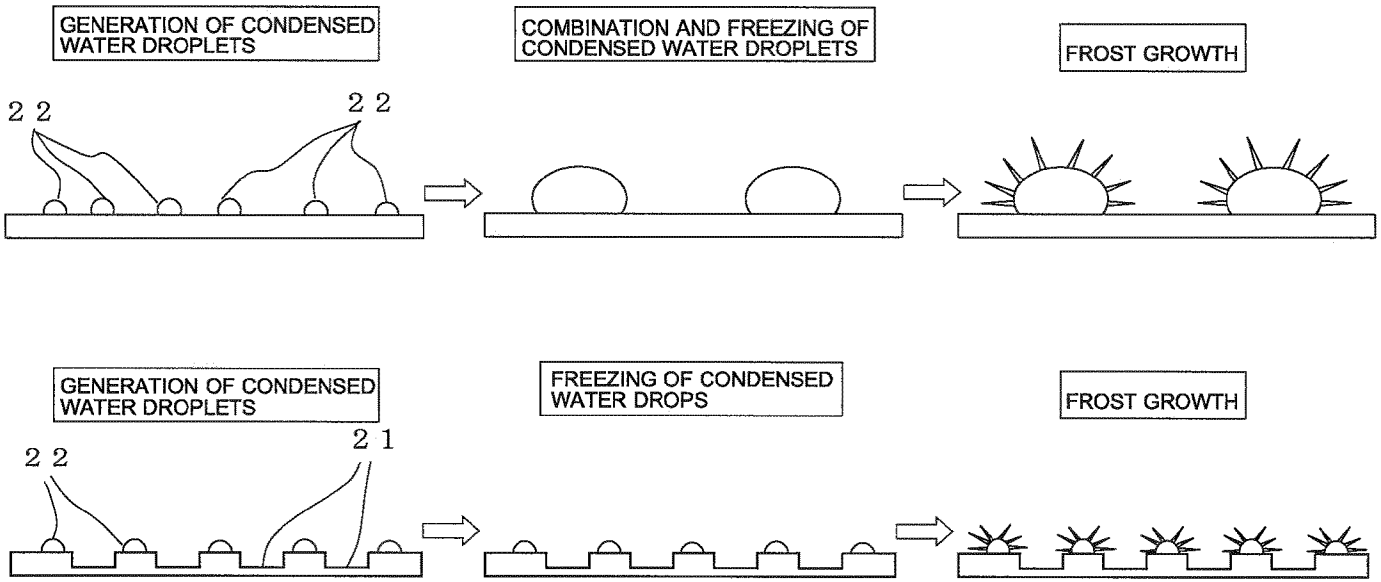
FIG. 10 includes schematic diagrams illustrating a process of frost growth on the surface of the evaporator applying the cross-fin type heat exchanger according to Embodiment 1 of the invention in comparison with one of the related art.

FIG. 10 illustrates a frost growth process upon frost formation on the heat transfer surface with the holes 21 having a radius smaller than the critical radius of a nucleus and that without the holes 21. In the case where the holes 21 are not arranged (FIG. 10(*a*)), adjacent condensed water droplets 22 generated on the heat transfer surface combine with each other into large water droplets and the large water droplets freeze and grow into frost. In the case where the holes 21 are arranged (FIG. 10(*b*)), condensed water droplets are generated on the metal part. Each condensed water droplet 22 freezes while having a small radius without combining with the neighboring water droplet across the hole 21 and then grows into frost. Accordingly, the frost has high density and low height. Consequently, clogging of the spaces (air paths) between the heat transfer fins is delayed.

As described above, by providing the holes 21 having a radius smaller than the critical radius of a nucleus, in which the critical radius is determined by use conditions (the air conditions and the cooled surface conditions) of the apparatus, on each heat transfer surface, drainage is improved, thus defrosting time is shortened. In addition, clogging of the spaces (air paths) between the heat transfer fins is delayed, thus reducing the number of defrosting operations.

Each of the arranged holes has a nanosize diameter that is sufficiently smaller than the diameter of foreign matter or dust typically expected to exist in an indoor space and an outdoor location. Accordingly, the hole is not clogged with foreign matter or dust. The performance can be maintained over time.

Figure 19:
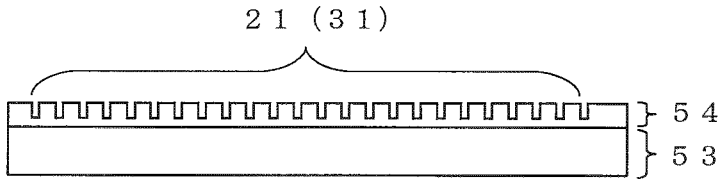
FIG. 19 is a schematic enlarged view of an oxide film on a metal base that has been subjected to anodizing.

In consideration of the strength of each actual fin and that of each actual heat transfer tube, the depth of each hole is preferably a depth that does not penetrate therethrough. Examples of methods of forming holes in, for example, aluminum fins and aluminum heat transfer tubes include anodizing illustrated in FIG. 16. Anodizing is a direct current electrolytic process in an electrolyte solution using metal to be treated as the anode and an insoluble electrode as the cathode. Electrical connection between the anode and the cathode oxidizes the surface of the metal, serving as the anode. Part of the metal is ionized and dissolved into the electrolyte solution. An oxide film 54, formed in this manner, has low electric conductivity. As anodizing progresses, metal oxide is formed on a base metal 53 as illustrated in FIG. 19, thus forming a structure with holes grown regularly. The depth of each hole 21 depends on voltage applying time. As described above, the holes may be preferably formed such that each hole does not penetrate through. Furthermore, the oxide film 54 has low thermal conductivity. Accordingly, heat exchange between the surface and the air is deteriorated. Formation of deep holes is therefore not necessarily good. However, penetrating holes offer essentially the same advantages as those described above. Although penetrating holes are not formed in the heat transfer tubes 9 because the refrigerant leaks through the penetrating holes, penetrating holes may be formed in the heat transfer fins 8.

The oxide film 54, formed by anodizing, has high corrosion resistance. Advantageously, reliability is increased. In the case where the heat transfer fins 8 and the heat transfer tubes 9 are made of metal, such as aluminum, which can be treated by anodizing, the heat transfer fins and the heat transfer tubes assembled into the heat exchanger, as illustrated in FIG. 2, can be easily treated advantageously.

The technique described in Embodiment 1 is to improve the drainage and delay clogging of the spaces (air paths) between the heat transfer fins. It is needless to say that this technique can be applied to a cross-fin type heat exchanger including heat transfer tubes with other shapes, for example, rounded heat transfer tubes as well as the cross-fin type heat exchanger including the flat heat transfer tubes 9.

By using the cross-fin type heat exchanger according to Embodiment 2 in the refrigeration cycle apparatus as described above, the time until clogging of the spaces (air paths) between the heat transfer fins can be extended and the defrosting time can be shortened, such that a highly efficient operation can be achieved. This results in energy saving. Application of this refrigeration cycle apparatus to, for example, an air-conditioning apparatus or a refrigerator enables the air conditioning apparatus or refrigerator to perform a highly efficient operation. In the application to, for example, an air-conditioning apparatus, the technique can be applied to a heat exchanger in which the fin pitch (fin interval) ranges from 1.0 mm to 2.5 mm and the outside diameter of each rounded heat transfer tube ranges from approximately 4 mm to approximately 13 mm. In the application to an apparatus used as a unit cooler, a display case, or a refrigerator, the technique can be applied to a heat exchanger in which the fin pitch (fin interval) ranges from 4.0 mm to 10 mm and the outside diameter of each rounded heat transfer tube ranges from approximately 6 mm to approximately 16 mm.

Embodiment 2

The structure of the cross-fin type heat exchanger according to Embodiment 2 of the invention will now be described with reference to FIGS. 11 to 13. Since a refrigerant circuit has the same configuration as that illustrated in FIG. 1 described in Embodiment 1, the description will be made with reference to FIG. 1.

In the cross-fin type heat exchanger according to Embodiment 2, heat transfer fins 8 and heat transfer tubes 9, which constitute an evaporator 5, have surfaces for transferring heat between air. As illustrated in FIG. 11, the heat transfer surfaces have holes 31 where the freezing point of condensed water droplets is lowered by the Gibbs-Thomson effect expressed by the following Equations (5) and (6).

Specifically, although attention has been paid to the phase change from water vapor to condensed water droplets in Embodiment 1 described above, attention will be paid to phase change from condensed water droplets to ice droplets in Embodiment 2. As regards a change in melt phase, a variation $d\mu$ in chemical potential per molecule is given using a temperature T in liquid phase by the following Equation (5).

[Math. 5]

$$d\mu = \frac{L(T_m - T)}{T_m} \quad (5)$$

In this equation, L denotes the latent heat of melting and Tm denotes the freezing temperature.

Substitution of Equation (5) into Equation (2) yields the following Equation (6).

[Math. 6]

$$T_m - T = \left(\frac{2\gamma v T_m}{L}\right)\frac{1}{r^*} \quad (6)$$

The left side of Equation (6) denotes the difference between the freezing temperature and the temperature in the liquid phase. Since the right side of Equation (6) is non-negative, Tm<T which expresses a depression of the freezing temperature in the liquid phase.

Figure 12:
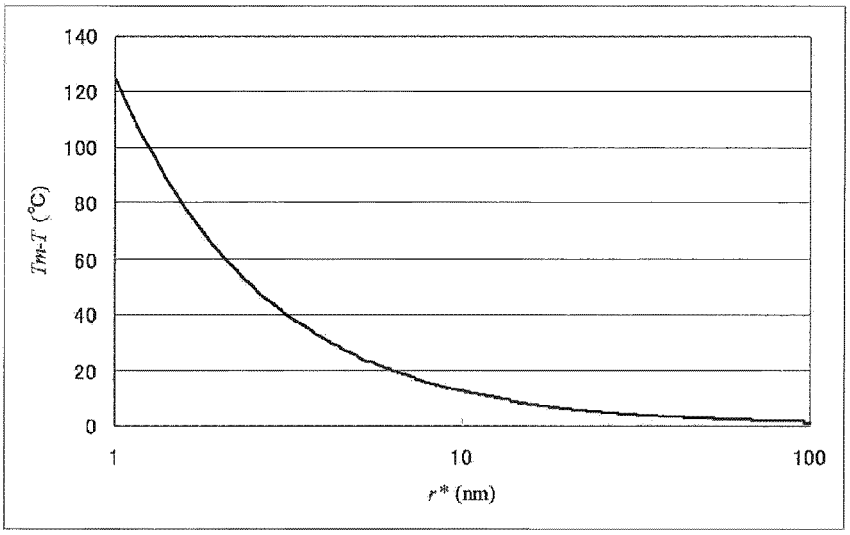
FIG. 12 is a graph illustrating the critical radius dependence of condensed water droplets whose freezing point has been depressed.

FIG. 12 is a graph illustrating the r* dependence of Tm−T of water. Note that Tm=273 [K] and $L=9.97*10^{-14}$[erg] (physical properties of water) are used. As illustrated in FIG. 12, Tm−T increases with decreasing r*. In other words, the lower r*, the larger the freezing point depression. This effect is called the Gibbs-Thomson effect.

Figure 11:
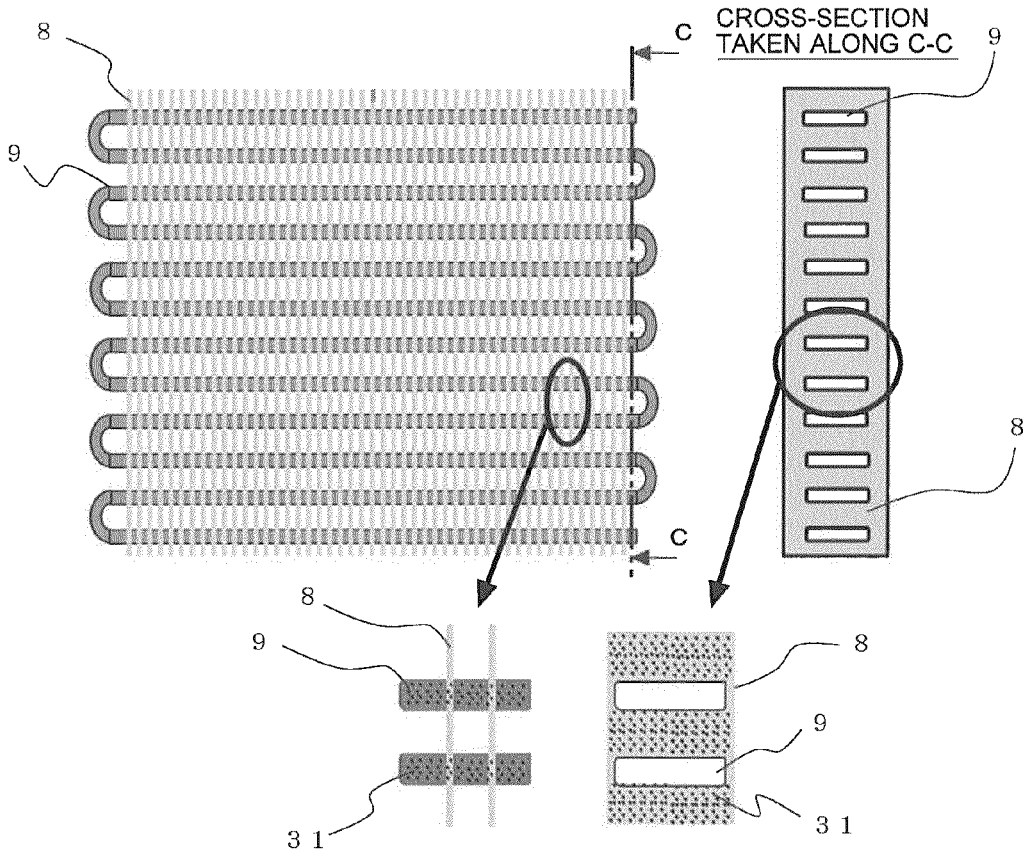
FIG. 11 includes a front view of an evaporator applying the cross-fin type heat exchanger according to Embodiment 2 of the invention, a cross-sectional arrow view thereof taken along the line indicated by arrows C-C, and enlarged views of essential parts thereof.

For example, assuming that the holes 31 each have a radius of 10 nm in FIG. 11 and the holes 31 are filled with condensed water droplets, the radius of each condensed water droplet may be 10 nm. FIG. 12 demonstrates that the freezing temperature of the condensed water droplet in each hole 31 is approximately −15° C. in this case. At this time, if the heat transfer surfaces of the evaporator 5 are cooled to −10° C., the condensed water droplets in the holes 31 do not freeze and the water droplets on an area excluding the holes 31 turn into ice droplets. This results in a reduction in the amount of frost. Specifically, the arrangement of the holes 31 having the radius r* in Equation (6) on the entire heat transfer surfaces lowers the freezing point of the condensed water droplets, thus reducing the amount of frost. Advantageously, clogging of the spaces (air paths) between the heat transfer fins can be delayed.

Figure 13:
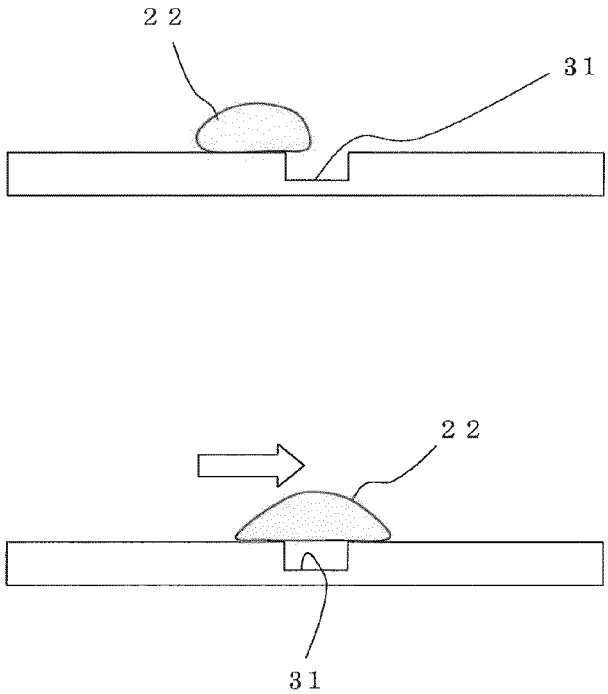
FIG. 13 includes schematic diagrams illustrating the drainage of a surface of the evaporator applying the cross-fin type heat exchanger according to Embodiment 2 of the invention.

Furthermore, each hole 31 is filled with water at all times as illustrated in FIG. 13. Consequently, since the surface energy of water is higher than that of metal, water moves from the surface of metal to the surface of water. Such a force becomes driving force, thus improving the drainage.

As described above, by providing, on the heat transfer surfaces, holes having a radius smaller than the radius determined by use conditions of the apparatus and Equation (6), namely, the holes 31 having the radius at which the freezing temperature of water droplets in the holes is lower than the temperature of the heat transfer surfaces, advantageously, the drainage is improved, thus defrosting time is shortened. In addition, clogging of the spaces (air paths) between the heat transfer fins is delayed, thus reducing the number of defrosting operation times.

Each of the arranged holes in Embodiment 2 also has a nanosize diameter that is sufficiently smaller than the diameter of foreign matter or dust typically expected to exist in an indoor space and an outdoor location. Accordingly, the hole is not clogged with foreign matter or dust. The performance can be maintained over time.

In Embodiment 2 as well, when the strength of each actual fin and that of each actual heat transfer tube is taken into consideration, the depth of each hole is preferably a depth that does not penetrate therethrough. Examples of methods of forming holes in, for example, aluminum fins and aluminum heat transfer tubes include anodizing illustrated in FIG. 16. As described above, anodizing is a direct current electrolytic process in an electrolyte solution using metal to be treated as the anode and an insoluble electrode as the cathode. Electrical connection between the anode and the cathode oxidizes the surface of the metal, serving as the anode. Part of the metal is ionized and dissolved into the electrolyte solution. The oxide film 54, formed in this manner, has low electric conductivity. As anodizing progresses, metal oxide is formed on the base metal 53 as illustrated in FIG. 19, thus forming a structure with holes grown regularly. The depth of each hole 31 depends on voltage applying time. As described above, the holes may be formed such that each hole does not penetrate through. Furthermore, the oxide film 54 has low thermal conductivity. Accordingly, heat exchange between the surface and the air is deteriorated. Formation of deep holes is therefore not necessarily good. However, penetrating holes essentially offer the same advantages as those described above. In other words, since the holes 31 are filled with water having surface energy higher than that of metal at all times, the effect of improving the drainage is obtained. As described above, it is needless to say that although penetrating holes are not formed in the heat transfer tubes 9 because the refrigerant leaks through the penetrating holes, penetrating holes may be formed in the heat transfer fins 8.

As described above, the oxide film, formed by anodizing, has high corrosion resistance. Advantageously, improved reliability is obtained. In the case where the heat transfer fins 8 and the heat transfer tubes 9 are made of metal, such as aluminum, which can be treated by anodizing, the heat transfer fins and the heat transfer tubes assembled into the heat exchanger, as illustrated in FIG. 2, can be easily treated advantageously.

The technique described in Embodiment 2 is also to improve the drainage and delay clogging of the spaces (air paths) between the heat transfer fins. It is needless to say that this technique can be applied to a cross-fin type heat exchanger including another shaped heat transfer tubes, for example, rounded heat transfer tubes as well as the cross-fin type heat exchanger including the flat heat transfer tubes 9.

By using the cross-fin type heat exchanger according to Embodiment 2 in the refrigeration cycle apparatus as described above, the time until clogging of the spaces (air paths) between the heat transfer fins can be extended and the defrosting time can be shortened, such that a highly efficient operation can be achieved. This results in energy saving. Application of this refrigeration cycle apparatus to, for example, an air-conditioning apparatus or a refrigerator enables the air conditioning apparatus or refrigerator to perform a highly efficient operation. In the application to, for example, an air-conditioning apparatus, the technique can be applied to a heat exchanger in which the fin pitch (fin interval) ranges from 1.0 mm to 2.5 mm and the outside diameter of each rounded heat transfer tube ranges from approximately 4 mm to approximately 13 mm. In the application to an apparatus used as a unit cooler, a display case, or a refrigerator, the technique can be applied to a heat exchanger in which the fin pitch (fin interval) ranges from 4.0 mm to 10 mm and the outside diameter of each rounded heat transfer tube ranges from approximately 6 mm to approximately 16 mm.

Embodiment 3

The structure of the cross-fin type heat exchanger according to Embodiment 3 of the invention will now be described with reference to FIGS. 14 to 19. Since a refrigerant circuit has the same configuration as that illustrated in FIG. 1 described in Embodiment 1, the description will be made with reference to FIG. 1.

Figure 14:
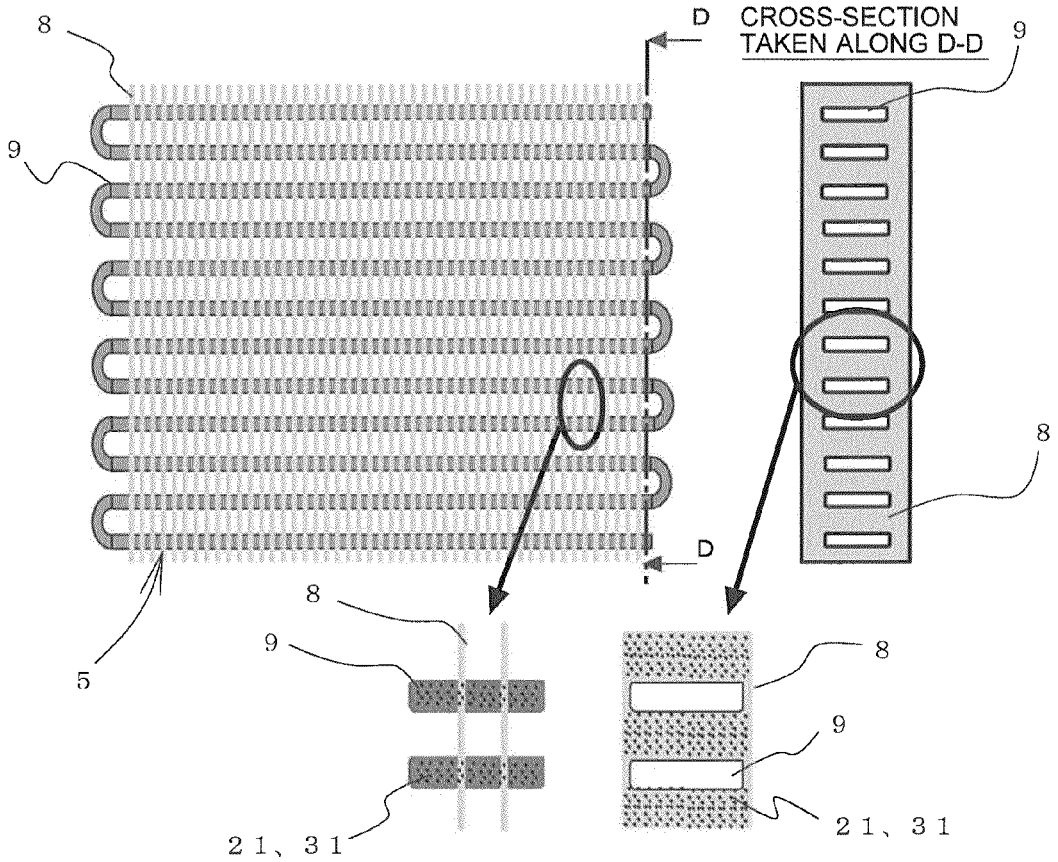
FIG. 14 includes a front view of an evaporator applying the cross-fin type heat exchanger according to Embodiment 3 of the invention, a cross-sectional arrow view thereof taken along the line indicated by arrows D-D, and enlarged views of essential parts thereof.

In the cross-fin type heat exchanger according to Embodiment 3 of the invention, heat transfer fins 8 and heat transfer tubes 9, which constitute an evaporator 5, have surfaces for transferring heat between air. As illustrated in FIG. 14, the heat transfer surfaces each have a mixed arrangement of first holes (the holes described in Embodiment 1) 21 having a radius smaller than the critical radius of a nucleus generated upon phase change from water vapor to condensed water droplets and second holes (the holes described in Embodiment 2) 31 having a radius at which the freezing temperature of a water droplet in the hole is lower than the temperature of the heat transfer surfaces.

Figure 15:
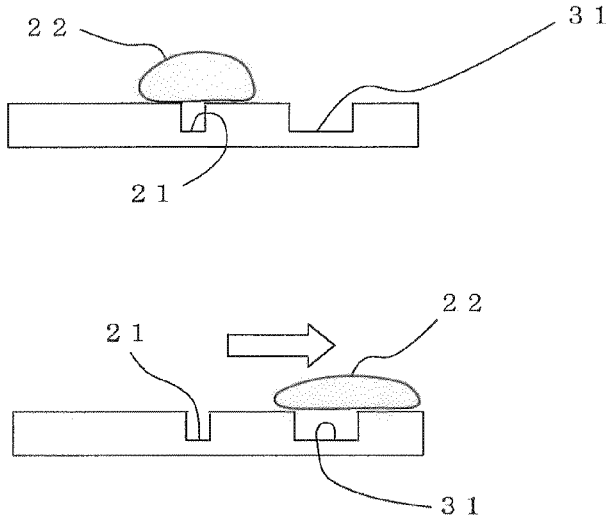
FIG. 15 includes schematic diagrams illustrating the drainage of a surface of the evaporator applying the cross-fin type heat exchanger according to Embodiment 3 of the invention.

The holes 21 enable the density of frost layers to be increased, thus obtaining the effect of delaying clogging of the spaces (air paths) between the heat transfer fins. The holes 31 reduce the amount of frost, thus obtaining the effect of delaying clogging of the spaces (air paths) between the heat transfer fins. Advantageously, the synergy of these effects further delays clogging of the spaces (air paths) between the heat transfer fins. Furthermore, the mixed arrangement of the holes 21 and the holes 31, as illustrated in FIG. 15, allows an air layer portion in each hole 21 to have minimum surface energy, allows the metal part to have higher surface energy, and allows a portion filled with water at all times in each hole 31 to have highest surface energy. In other words, water on each heat transfer surface obtains a driving force causing movement from the hole 21 through the metal part to the hole 31, so that drainage is further improved.

As described above, the first holes 21 having a radius smaller than the critical radius of a nucleus that occurs upon phase change from water vapor to condensed water droplets and the second holes 31 having a radius at which the freezing temperature, determined by use conditions of an apparatus, of the water droplets is lower than the temperature of the heat transfer surfaces are arranged on each heat transfer surface. Advantageously, the drainage is improved, thus shortening the defrosting time. In addition, clogging of the spaces (air paths) between the heat transfer fins can be delayed, thus reducing the number of defrosting operation times.

Each of the arranged holes in Embodiment 3 has a nanosize diameter that is sufficiently smaller than the diameter of foreign matter or dust typically expected to exist in an indoor space and an outdoor location. Accordingly, the hole is not clogged and performance can be maintained over time.

In Embodiment 3 as well, when the strength of each actual fin and that of each actual heat transfer tube is taken into consideration, the depth of each hole is preferably a depth that does not penetrate therethrough. Examples of methods of forming holes in, for example, aluminum fins and aluminum heat transfer tubes include anodizing illustrated in FIG. 16. As described above, anodizing is a direct current electrolytic process in an electrolyte solution using metal to be treated as the anode and an insoluble electrode as the cathode. Electrical connection between the anode and the cathode oxidizes the surface of the metal, serving as the anode. Part of the metal is ionized and dissolved into the electrolyte solution. The oxide film 54, formed in this manner, has low electric conductivity. As anodizing progresses, metal oxide is formed on the base metal 53 as illustrated in FIG. 19, thus forming a structure with holes grown regularly. The depth of each of the holes 21 and 31 depends on voltage applying time. As described above, the holes may be preferably formed such that each hole does not penetrate through. Furthermore, the oxide film has low thermal conductivity. Accordingly, heat exchange between the surface and the air is deteriorated. Formation of deep holes is therefore not necessarily good. However, penetrating holes essentially offer the same advantages as those described above. Although penetrating holes are not formed in the heat transfer tubes 9 because the refrigerant leaks through the penetrating holes, penetrating holes may be formed in the heat transfer fins 8.

As described above, the oxide film 54, formed by anodizing, has high corrosion resistance. Advantageously, improved reliability is obtained. In the case where the heat transfer fins 8 and the heat transfer tubes 9 are made of metal, such as aluminum, which can be treated by anodizing, the heat transfer fins and the heat transfer tubes assembled into the heat exchanger, as illustrated in FIG. 2, can be easily treated advantageously.

Figure 16:
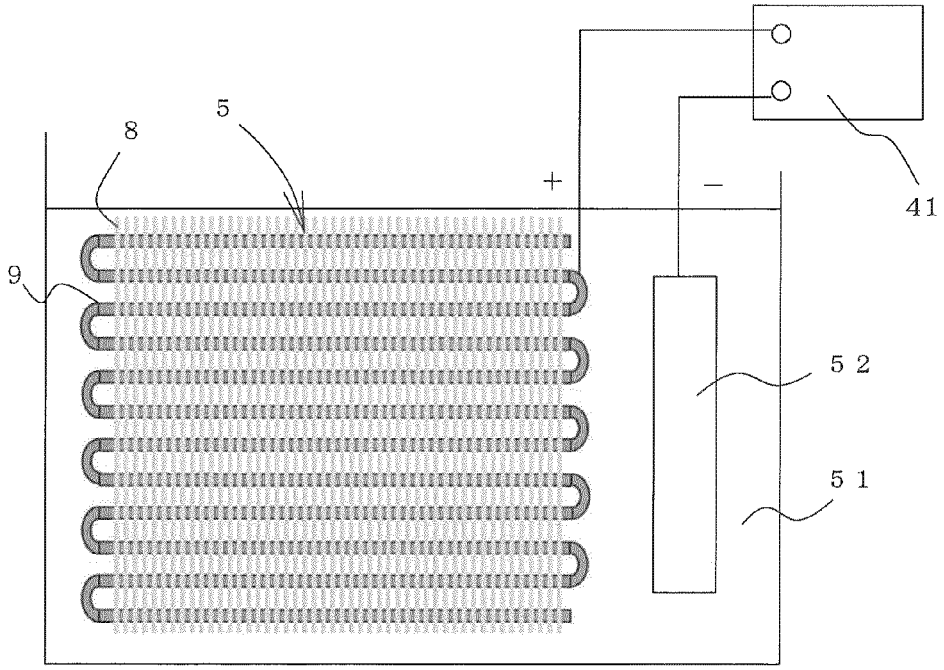
FIG. 16 is a schematic diagram illustrating an anodizing procedure of the cross-fin type heat exchanger according to Embodiment 3 of the invention.
Figure 17:
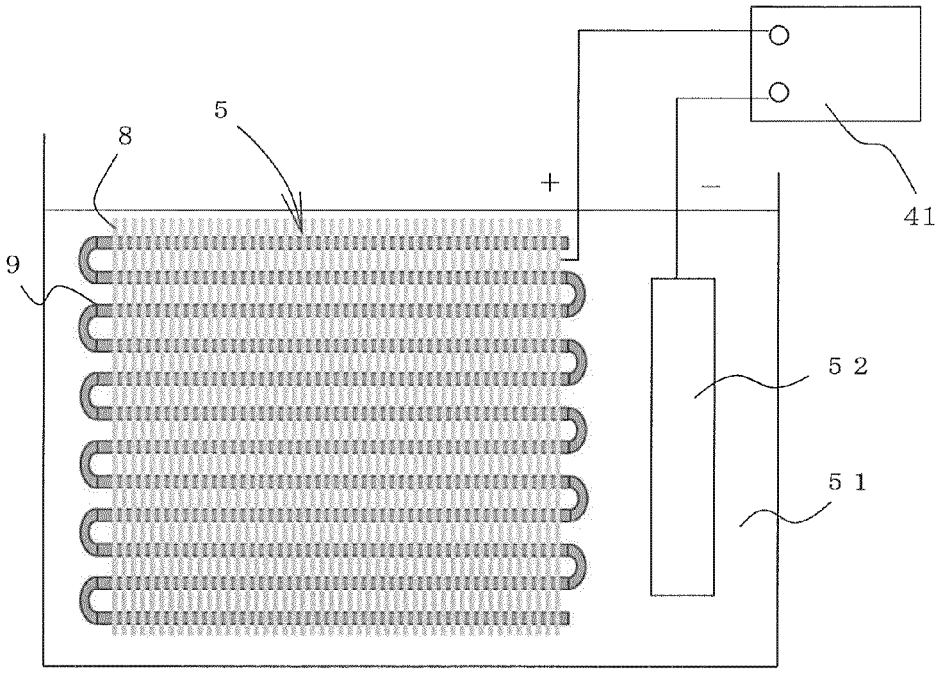
FIG. 17 includes schematic enlarged views of essential parts of the cross-fin type heat exchanger according to Embodiment 3 of the invention that has been subjected to anodizing.
Figure 18:
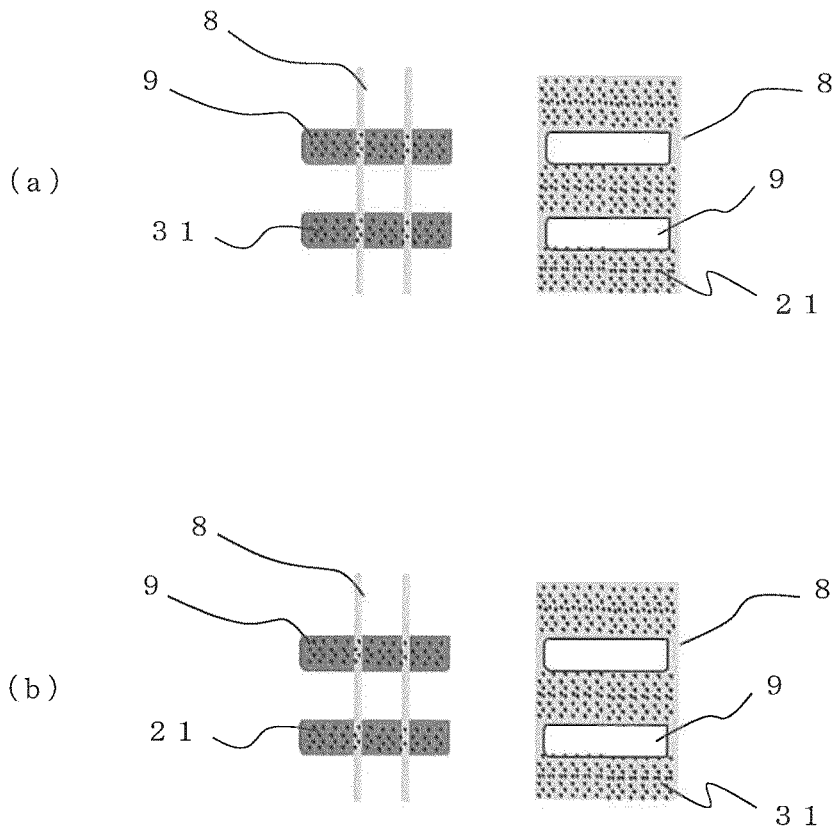
FIG. 18 is a schematic diagram illustrating an anodizing method of the evaporator applying the cross-fin type heat exchanger according to Embodiment 3 of the invention.

In anodizing, the diameter of each hole depends on the current. In the case where the heat exchanger is to be the anode and an electrode 41 is connected to a heat transfer tube 9 as illustrated in FIG. 16, current tends to flow to the heat transfer tubes 9 such that large holes 31 are easily formed on the heat transfer tubes 9 as illustrated in FIG. 18(*a*). On the other hand, in the case where the heat transfer fins 8 are connected to the electrode as illustrated in FIG. 17, current tends to flow to the heat transfer fins 8 such that large holes 31 are formed on the heat transfer fins 8 as illustrated in FIG. 18(*b*).

To improve drainage from the heat transfer tubes as in the case of the cross-fin type heat exchanger employing the flat heat transfer tubes, it is therefore preferable that the diameter of each hole in the heat transfer tubes 9 be increased in order to increase the area of water having high surface energy so that the drainage is improved. In particular, when providing the first holes 21 and the second holes 31 on both the heat transfer tubes 9 and the heat transfer fins 8 by anodization, the diameter of the first and second holes on the heat transfer tubes is made to be larger than the diameter of the first and second holes on the heat transfer fins by connecting a power supply only to the heat transfer tubes.

Furthermore, in the case where the fin pitch is so narrow that a bridge of water droplets is formed between the heat transfer fins and the drainage from the heat transfer fins 8 accordingly deteriorates, it is preferable that the diameter of each hole in the heat transfer fins 8 be increased in order to improve the drainage.

The technique described in Embodiment 3 is also to improve the drainage and delay clogging of the spaces (air paths) between the heat transfer fins. It is needless to say that this technique can be applied to a cross-fin type heat exchanger including another shaped heat transfer tubes, for example, rounded heat transfer tubes as well as the cross-fin type heat exchanger including the flat heat transfer tubes 9.

By using the cross-fin type heat exchanger according to Embodiment 3 in a refrigeration cycle apparatus as described above, the time it takes for the spaces (air paths) between the heat transfer fins to be clogged can be extended and the defrosting time can be shortened, so that a highly efficient operation can be achieved. This results in energy saving. Application of this refrigeration cycle apparatus to, for example, an air-conditioning apparatus or a refrigerator enables the air conditioning apparatus or refrigerator to perform a highly efficient operation. In the application to, for example, an air-conditioning apparatus, the technique can be applied to a heat exchanger in which the fin pitch (fin interval) ranges from 1.0 mm to 2.5 mm and the outside diameter of each rounded heat transfer tube ranges from approximately 4 mm to approximately 13 mm. In the application to an apparatus used as a unit cooler, a display case, or a refrigerator, the technique can be applied to a heat exchanger in which the fin pitch (fin interval) ranges from 4.0 mm to 10 mm and the outside diameter of each rounded heat transfer tube ranges from approximately 6 mm to approximately 16 mm.

INDUSTRIAL APPLICABILITY

With application of the invention, problem of frost formation, at or below 0° C., on the surface of a heat exchanger that exchange heat with air can be solved. In an air-conditioning apparatus or a refrigerator including a refrigeration cycle apparatus, clogging of the spaces (air paths) between heat transfer fins or the defrosting operation has been causing reduction in efficiency. By using the refrigeration cycle apparatus including the cross-fin type heat exchanger of the invention to an air-conditioning apparatus or a refrigerator, time until the spaces (air paths) between the heat transfer fins becomes clogged can be extended and defrosting time can be shortened, such that a highly efficient operation of the air-conditioning apparatus or refrigerator can be achieved; hence, energy saving cab be achieved.

REFERENCE SIGNS LIST

1. compressor; 3 condenser; 4 expansion valve (expansion means); 5 evaporator; 8 heat transfer fin; 9 heat transfer tube; 21 hole (hole having a radius equal to or smaller than the critical radius of a nucleus); 22 condensed water droplet; 31 hole (hole having a radius that offers the Gibbs-Thomson effect); 53 base metal; 54 oxide film.

The invention claimed is:

1. A cross-fin type heat exchanger in which a plurality of heat transfer fins are arranged in an array around straight pipe portions of a flat serpentine heat transfer tube with a plurality of bends, the cross-fin type heat exchanger comprising:

holes provided on heat transfer surfaces of the heat transfer tubes and holes provided on heat transfer surfaces of the heat transfer fins for transferring heat with air, every hole provided on the heat transfer surfaces of the heat transfer tubes and every hole provided on the heat transfer surfaces of the heat transfer fins having a radius smaller than a critical radius of a nucleus that is generated upon phase change from water vapor to condensed water droplets, wherein every hole provided on the heat transfer surfaces of the heat transfer tubes has a diameter larger than a diameter of every hole provided on the heat transfer surfaces of the heat transfer fins.

2. The cross-fin type heat exchanger of claim 1, wherein the holes on the heat transfer surfaces are formed by anodizing.

3. The cross-fin type heat exchanger of claim 2, wherein the heat transfer tubes and the heat transfer fins assembled into the heat exchanger are subjected to the anodizing.

4. The cross-fin type heat exchanger of claim 3, wherein upon formation of the holes on the heat transfer surfaces by anodization, the diameter of the holes on the heat transfer tubes is larger than the diameter of the holes on the heat transfer fins by connecting a power supply only to the heat transfer tubes.

5. The cross-fin type heat exchanger of claim 3, wherein the formation of the holes on the heat transfer surfaces by anodization forms an oxide film.

6. A refrigeration cycle apparatus, comprising:

at least a compressor, a condenser, expansion means, and an evaporator which are connected in a closed loop by refrigerant pipes to form a refrigerant circuit, the refrigerant circuit being filled with a refrigerant, wherein the cross-fin type heat exchanger of claim 1 is employed as the evaporator.

7. A cross-fin type heat exchanger in which a plurality of heat transfer fins are arranged in an array around straight pipe portions of a flat serpentine heat transfer tube with a plurality of bends, the cross-fin type heat exchanger comprising:

holes provided on heat transfer surfaces of the heat transfer tubes and holes provided on heat transfer surfaces of the heat transfer fins for transferring heat with air, every hole provided on the heat transfer surfaces of the heat transfer tubes and every hole provided on the heat transfer surfaces of the heat transfer fins having such a radius that the freezing temperature of a water droplet in the holes is lower than the temperature of the heat transfer surfaces, wherein every hole provided on the heat transfer surfaces of the heat transfer tubes has a diameter larger than a diameter of every hole provided on the heat transfer surfaces of the heat transfer fins.

8. A cross-fin type heat exchanger in which a plurality of heat transfer fins are arranged in an array around straight pipe portions of a flat serpentine heat transfer tube with a plurality of bends, the cross-fin type heat exchanger comprising:

first holes each having a radius smaller than a critical radius of a nucleus that is generated upon phase change from water vapor to condensed water droplets; and second holes each having such a radius that the freezing temperature of a water droplet in the holes is lower than the temperature of the heat transfer surfaces, wherein the first holes and the second holes are both provided on heat transfer surfaces of the heat transfer tubes and the heat transfer fins for transferring heat with air, and every first hole of the heat transfer tubes and every second hole of the heat transfer tubes has a diameter larger than a diameter of every first hole of the heat transfer fins, and every second hole of the heat transfer tubes has a diameter larger than a diameter of every second hole of the heat transfer fins;

wherein every hole provided on the heat transfer surfaces of the heat transfer tubes has a diameter larger than a diameter of every hole provided on the heat transfer surfaces of the heat transfer fins.

* * * * *